US010598053B2

(12) United States Patent
Moetakef

(10) Patent No.: US 10,598,053 B2
(45) Date of Patent: Mar. 24, 2020

(54) PHASE CONTROL APPARATUS AND METHOD FOR OPERATION THEREOF

(71) Applicant: Ford Global Technologies, LLC, Dearborn, MI (US)

(72) Inventor: Mohammad Ali Moetakef, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 15/726,323

(22) Filed: Oct. 5, 2017

(65) Prior Publication Data

US 2019/0107013 A1 Apr. 11, 2019

(51) Int. Cl.
*F01L 1/34* (2006.01)
*F01L 1/344* (2006.01)

(52) U.S. Cl.
CPC ... *F01L 1/3442* (2013.01); *F01L 2001/34453* (2013.01); *F01L 2001/34456* (2013.01); *F01L 2001/34459* (2013.01); *F01L 2001/34463* (2013.01); *F01L 2001/34469* (2013.01); *F01L 2250/02* (2013.01); *F01L 2250/04* (2013.01); *F01L 2800/00* (2013.01)

(58) Field of Classification Search
CPC ..... F01L 1/3442; F01L 2001/34456; F01L 2001/34453; F01L 2001/34469
USPC ..... 123/90.15, 90.17
See application file for complete search history.

(56) References Cited

U.S. PATENT DOCUMENTS

| | | | | |
|---|---|---|---|---|
| 4,832,478 | A | 5/1989 | Salce | |
| 4,968,129 | A | 11/1990 | Grendol | |
| 5,343,723 | A | 9/1994 | Miller et al. | |
| 7,628,632 | B2 | 12/2009 | Holland | |
| 8,261,704 | B2 * | 9/2012 | Takemura | F01L 1/3442 123/90.15 |

* cited by examiner

*Primary Examiner* — Ching Chang
(74) *Attorney, Agent, or Firm* — Geoffrey Brumbaugh; McCoy Russell LLP

(57) ABSTRACT

Methods and devices are provided for locking and unlocking a phase control apparatus. In one example, a phase control apparatus is provided with a locking plate including a drive wheel, a pin recess, and a ramped channel opening into the pin recess and a housing coupled to the locking plate. The phase control apparatus also includes a vane rotor including a vane and positioned in a hydraulic chamber of the housing and a locking pin positioned within a bore of the vane and movable into a locked position where the locking pin engages with the pin recess.

15 Claims, 4 Drawing Sheets

PHASE CONTROL APPARATUS AND METHOD FOR OPERATION THEREOF

FIELD

The present description relates generally to a phase control apparatus in a variable cam timing system in an engine and a method for operation of such a system.

BACKGROUND/SUMMARY

Variable Cam Timing (VCT) has been used in internal combustion engines to provide valve timing adjustment with the intent to increase combustion efficiency. Consequently, engine's employing VCT can realize increased power output and reduced emissions. However, knock in VCT engines causes noise, vibration, and harshness (NVH) issues. As a result, customers may be dissatisfied with the VCT engine and in some cases complain of the unwanted noise. Such noise may originate within VCT actuators that use a locking pin to lock the rotor inside its housing during engine idle. The knock usually occurs during hot idle when the rotor, due to camshaft torque fluctuation, oscillates within the backlash between the locking pin and the pinhole and hits the housing. The camshaft torque fluctuation and the backlash between the locking pin and the pinhole are the two driving factors that can lead to knock in the cam phaser. In particular, a high speed approach of the rotor toward the housing may result in an impact between the two components, causing a ticking noise.

Attempts have been made to resolve the noise issues in VCT systems by repositioning the pinhole that is engaged by the locking pin in the locked position. The pinhole is repositioned with the goal of preventing direct impact between the vane rotor and the housing of the cam phaser. However, a high speed approach of the locking pin can cause incomplete engagement between the locking pin and the pinhole. Furthermore, slower speed approaches of the locking pins may also fall short of achieving impact avoidance. For example, friction and oil viscosity may cause a locking pin, preloaded by a spring, to not extend at a desired engagement speed. As a result, the vane rotor will bounce against the housing when a locking failure occurs, resulting in noise generation. Additionally, the incomplete engagement between the locking pin and the pinhole puts significant stress on the locking pin, causing deformation and durability issues.

To resolve at least some of the aforementioned problems, the inventors have developed a phase control apparatus for a camshaft. The phase control apparatus includes a locking plate including a drive wheel, a pin recess, and a ramped channel opening into the pin recess, a housing coupled to the locking plate, a vane rotor including a vane and positioned in a hydraulic chamber of the housing, and a locking pin positioned within a bore of the vane and movable into a locked position where the locking pin engages with the pin recess. In this way, the ramped channel can provide more time for the locking pin to extend into an engaged configuration. Consequently, NVH in the phase control apparatus can be diminished, and in some cases avoided. As a result, both the durability of the phase control apparatus and customer satisfaction are increased.

In one example, a thickness of the ramped channel decreases in an arced direction extending away from the pin recess. In this way, the likelihood of engagement between the locking pin and the pin recess can be further increased during high speed approaches of the locking pin, for instance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
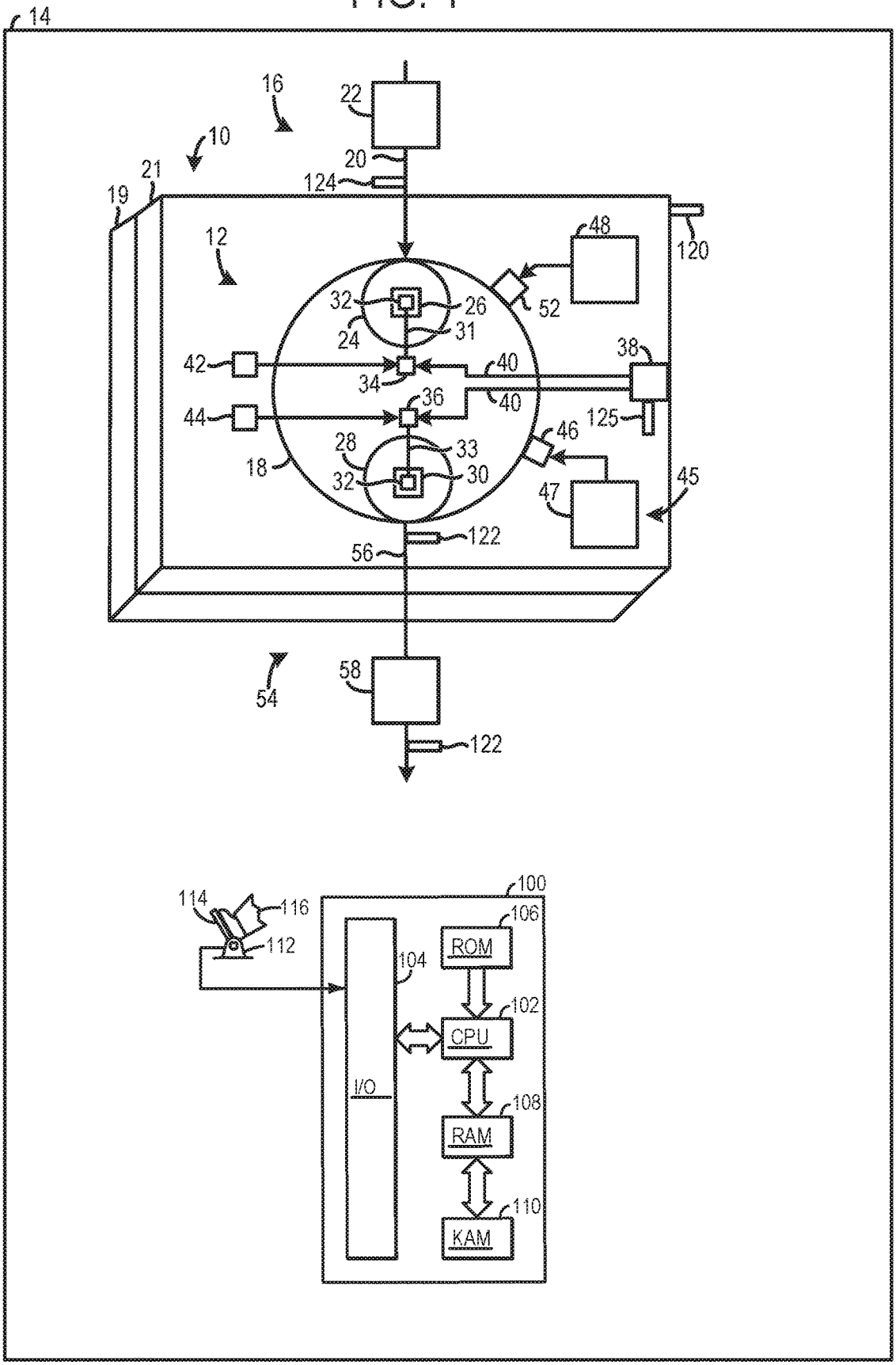
FIG. 1 shows a schematic depiction of an internal combustion engine including a variable cam timing system with phase control apparatuses.
Figure 2:
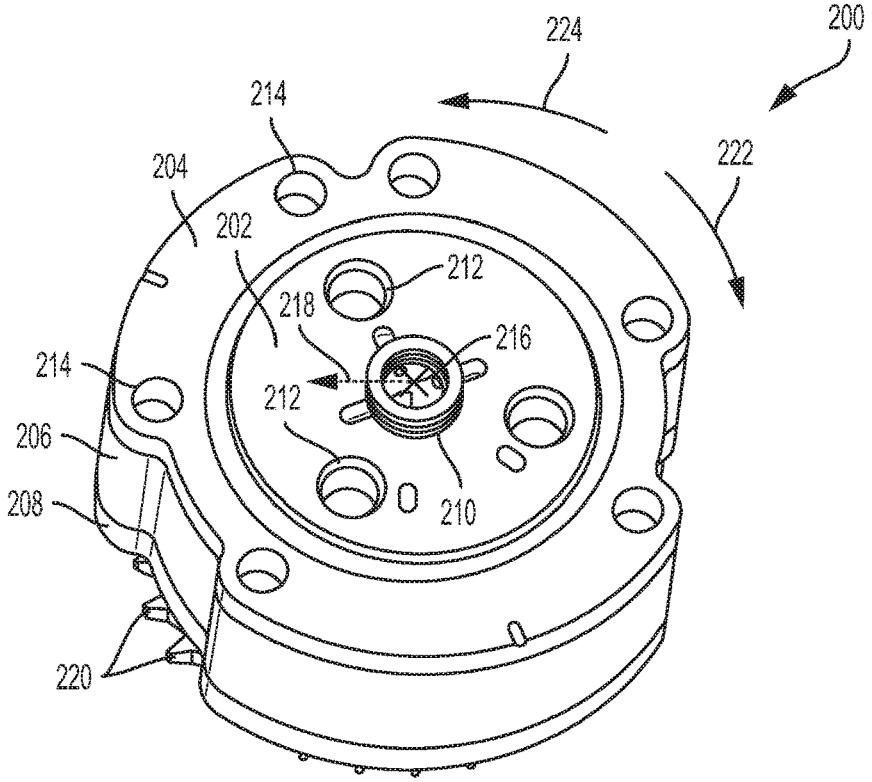
FIG. 2 shows an assembled view of an example of a phase control apparatus.
Figure 5:
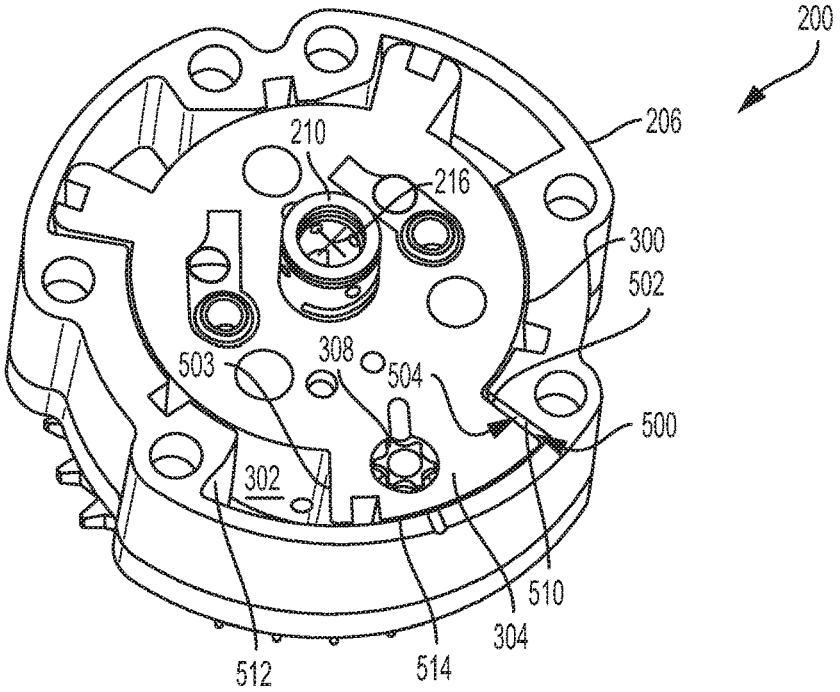
FIG. 5 shows the phase control apparatus, illustrated in FIG. 3, partially assembled.
Figure 3:
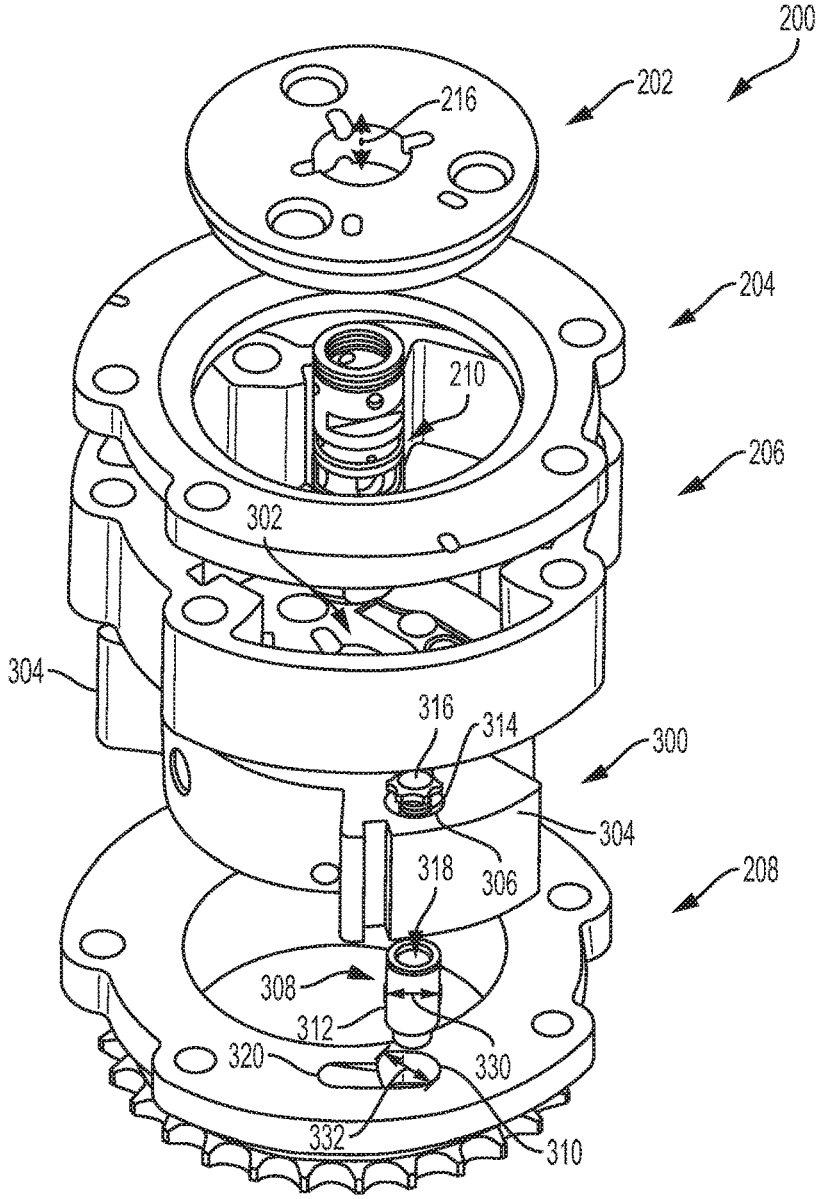
FIG. 3 shows an exploded view of the phase control apparatus, depicted in FIG. 2.
Figure 4:
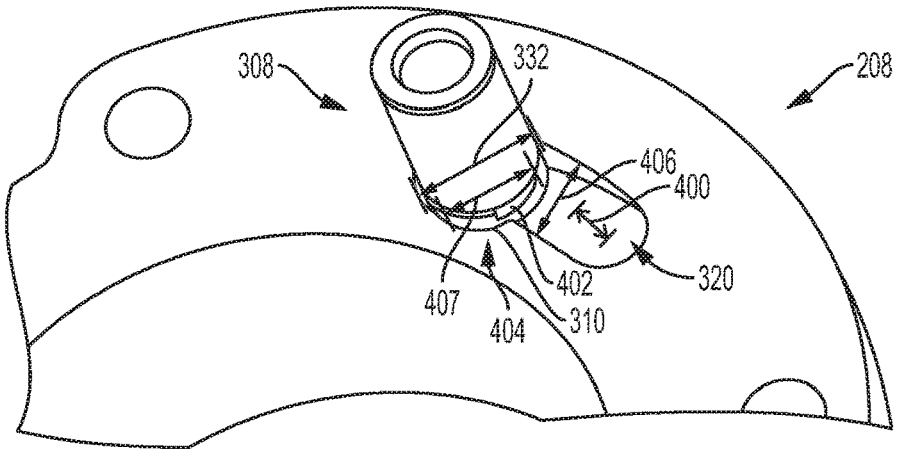
FIG. 4 shows a detailed view of a section of the phase control apparatus, shown in FIG. 3.
Figure 6:
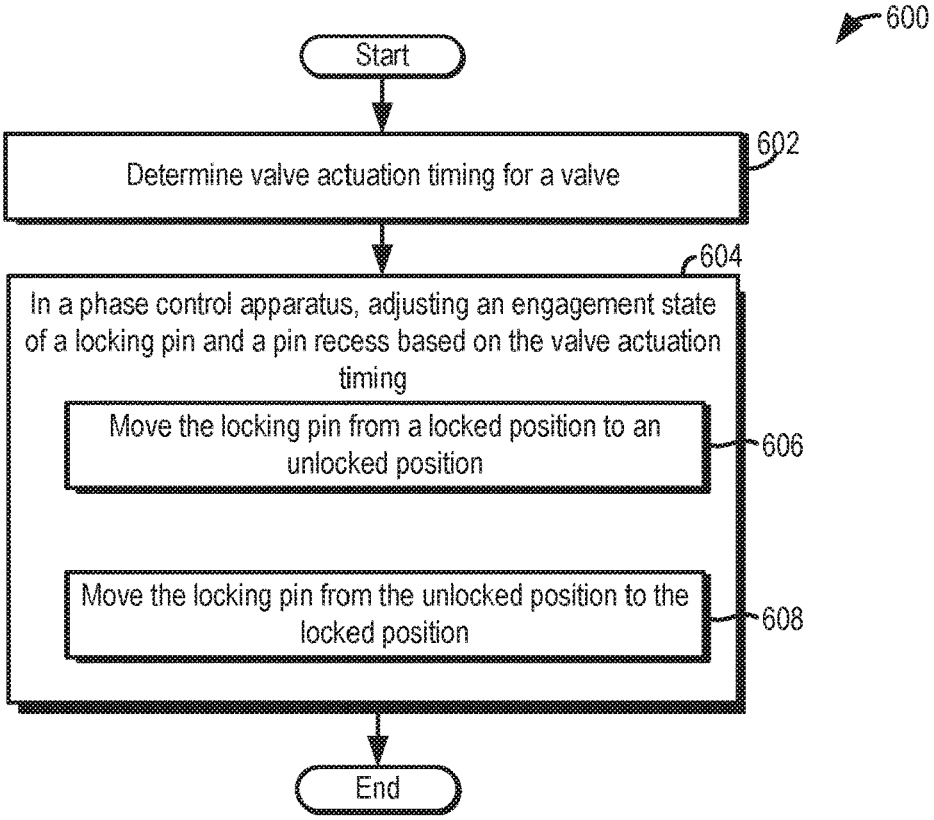
FIGS. 6 and 7 show methods for operation of a variable cam timing system.
Figure 7:
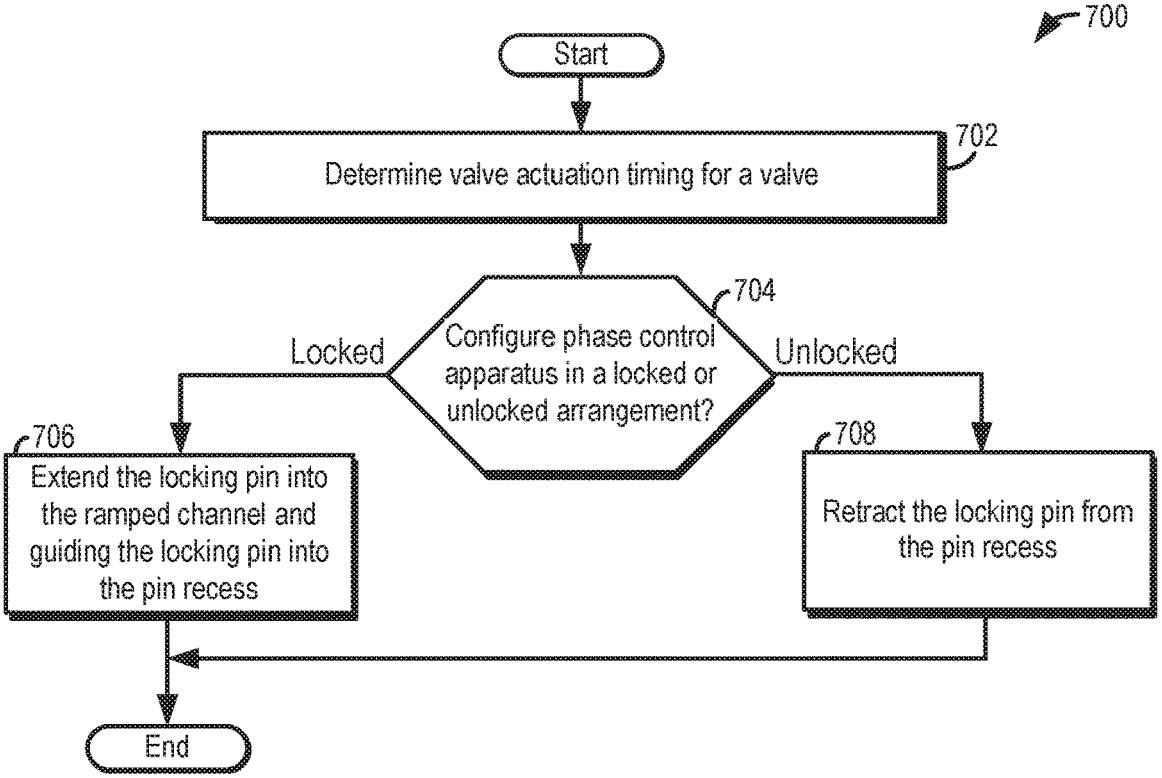

The following description relates to a phase control apparatus which decreases noise, vibration, and harshness (NVH) in a variable cam timing (VCT) system. The phase control apparatus includes a locking pin and pin recess that engage with one another to prevent valve timing adjustment by the apparatus, during certain operating conditions. A ramped channel leading into the pin recess is also provided in the apparatus to guide the locking pin into the pin recess. The ramped channel enables the locking pin to be smoothly guided into the pin recess during engagement. The ramped channel essentially gives the locking pin more time to extend into an engaged positioned within the pin recess, to reduce the likelihood of engagement failure between the locking pin in the pin recess due to a high speed approach of the locking pin, elevated oil viscosity, etc. As a result, the likelihood of impact between the vane rotor and the housing in the phase control apparatus can be reduced (e.g., avoided). Therefore, the longevity of the phase control apparatus is increased while also increasing customer satisfaction, due to the avoidance of the unwanted noise in the apparatus. FIG. 1 shows a schematic depiction of an engine employing a VCT system with a phase control apparatus. FIG. 2 shows an example of the phase control apparatus, shown in FIG. 1, in an assembled configuration. FIG. 3 shows the phase control apparatus, shown in FIG. 2, in an exploded state. FIG. 4 shows a detailed view of the locking pin and the ramped channel in the phase control apparatus, shown in FIG. 3. FIG. 5 shows a portion of the phase control apparatus, illustrated in FIG. 3, in assembled state. FIGS. 6 and 7 show methods for operation of a VCT system and phase control apparatus.

Turning to FIG. 1, an engine 10 with a VCT system 12 in a vehicle 14 is schematically illustrated. Although, FIG. 1 provides a schematic depiction of various engine and VCT system components, it will be appreciated that at least some of the components may have a different spatial positions and greater structural complexity than the components shown in FIG. 1. The structural details of the components are discussed in greater detail herein with regard to FIGS. 2-5.

An intake system 16 providing intake air to a combustion chamber 18 is also depicted in FIG. 1. The combustion chamber 18 is formed by a cylinder block 19 coupled to a cylinder head 21. Although, FIG. 1 depicts the engine 10 with one cylinder. The engine 10 may have an alternate number of cylinders, in other examples. For instance, the engine 10 may include two cylinders, three cylinders, six cylinders, etc., in other examples.

The intake system 16 includes an intake conduit 20 and a throttle 22 coupled to the intake conduit. The throttle 22 is configured to regulate the amount of airflow provided to the combustion chamber 18. In the depicted example, the intake conduit 20 feeds air to an intake valve 24. However, in other examples, such as in the case of a multi-cylinder engine, the intake system may further include an intake manifold.

The intake valve 24 may be actuated by an intake valve actuator 26. Likewise, an exhaust valve 28 may be actuated by an exhaust valve actuator 30. In the illustrated example, the intake valve actuator 26 and the exhaust valve actuator 30 employ cams 32 coupled to intake and exhaust valve camshafts, 31 and 33 respectively, to open/close the valves. It will be appreciated that the cams may be designed as lobes on a shaft that actuate poppet valves, in one example. Furthermore, the intake valve actuator 26 and the exhaust valve actuator 30 may be included in the VCT system 12, in some instances.

The VCT system 12 may further include an intake phase control apparatus 34 that is coupled to the intake valve actuator 26 and the intake valve camshaft 31. Likewise, the VCT system 12 also includes an exhaust phase control apparatus 36 that is coupled to the exhaust valve actuator 30 and the exhaust valve camshaft 33. The intake and exhaust phase control apparatuses may be more generally referred to as phase control apparatuses. The phase control apparatuses, 34 and 36, are configured to vary the timing of the valve to which they are coupled. For instance, the timing of the intake valve 24 and/or the exhaust valve 28 may be advanced or retarded based on engine operating conditions by the phase control apparatuses. Moreover, it will be appreciated that timing of the intake valve 24 and the exhaust valve 28 may be independently adjusted by the phase control apparatuses, 34 and 36. In the illustrated example, the engine may have two independent intake and exhaust phase control apparatuses, 34 and 36, each receiving rotational input from crankshaft 38, denoted via arrows 40. However, in other examples, a single phase control apparatus can be used to control the phases of the intake and exhaust camshafts. Furthermore, the phase control apparatuses, 34 and 36, receive oil from oil control valves 42 and 44, in the illustrated example. The oil control valves, 42 and 44, are configured to hydraulically adjust the phase angle between the crankshaft 38 and the camshafts, 31 and 33. The oil control valves 42 and 44 may receive oil from galleries in the engine. In particular, the oil control valve 42 is an intake valve timing oil control valve and the oil control valve 44 is an exhaust valve timing oil control valve, in the illustrated example.

The phase control apparatuses, 34 and 36, are also configured to be locked during certain operating conditions. Locking the phase control apparatuses sets the apparatus in one specific timing configuration and prevents further valve timing adjustments during said locking. For instance, the phase control apparatuses may be locked in a retarded valve timing configuration, in one example. In such an example, the phase control apparatus may be locked in a retarded valve timing configuration when the engine is operating at an idle speed or within an idle speed range for smooth engine operation.

An ignition system 45 may provide power (e.g., spark) to the combustion chamber. The ignition system 45 includes an ignition device 46 and an energy storage device 47 configured to provide power to the ignition device.

A fuel delivery system 48 is also shown in FIG. 1. The fuel delivery system 48 provides pressurized fuel to a direct fuel injector 52. The fuel delivery system 48 may include conventional components such as fuel tanks, fuel pumps, check valves, return lines, etc., to enable fuel to be provided to the injectors at desired pressures. It will be appreciated that in other examples, a port fuel injector may be additionally or alternatively included in the fuel delivery system 48.

An exhaust system 54 configured to manage exhaust gas from the combustion chamber 18 is also included in the vehicle 14, depicted in FIG. 1. The exhaust system 54 includes the exhaust valve 28 coupled to the combustion chamber 18, and exhaust conduit 56. The exhaust system 54 also includes an emission control device 58. The emission control device 58 may include filters, catalysts, absorbers, etc., for reducing tailpipe emissions.

During engine operation, the combustion chamber typically undergoes a four stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and exhaust valve are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited by a spark ignition system, resulting in combustion. It will be appreciated, that in other examples the engine may implement compression ignition. During the expansion stroke, the expanding gases push the piston back to BDC. A crankshaft converts this piston movement into a rotational torque of the rotary shaft. During the exhaust stroke, in a traditional design, the exhaust valve is opened to release the residual combusted air-fuel mixture to the corresponding exhaust passages and the piston returns to TDC.

FIG. 1 also shows a controller 100 in the vehicle 14. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 120, exhaust gas sensors 122, an intake airflow sensor 124, and engine speed sensor 125, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the throttle 22, VCT system 12, ignition system 45, and/or fuel delivery system 48. Specifically, the controller 100 may be configured to send signals to the oil control valves 42 and 44, the intake phase control apparatus 34, exhaust phase control apparatus 36, ignition device 46, and/or direct fuel injector 52 to adjust combustion operation, intake valve timing, and/or exhaust valve timing. Therefore, the controller 100 receives signals from the various sensors and employs the various actuators to adjust engine operation based on the received signals and instructions stored in memory of the controller. Thus, it will be appreciated that the controller 100 may send and receive signals from the VCT system 12.

For example, adjusting the intake or exhaust phase control apparatus may include adjusting an actuator (e.g., oil control valve) to adjust the phase control apparatus. In yet another example, the amount of intake and/or exhaust valve timing adjustment may be empirically determined and stored in a predetermined lookup tables or functions. For example, one table may correspond to determining an amount of valve timing advancement, one table may corresponding to determining an amount of valve timing retardation, and one table may correspond to determining when to implement locking and unlocking in a phase control apparatus. The tables may be indexed to engine operating conditions, such as engine speed, engine load, and engine temperature, among other engine operating conditions. Furthermore, the tables may output an amount of valve advancement or retardation and/or a phase control apparatus locking condition that is sent to the VCT system.

It will also be appreciated that the engine 10 may also employ a boosting system (e.g., turbocharger, supercharger, etc.) and/or an exhaust gas recirculation system, in some examples.

FIG. 2 shows an assembled view of a phase control apparatus 200. It will be appreciated that the phase control apparatus 200, shown in FIG. 2, is an example of one of the phase control apparatuses, 34 and 36, shown in FIG. 1, and therefore may be included in the VCT system 12, shown in FIG. 1. As illustrated, the phase control apparatus 200 includes an inner cover plate 202, an outer cover plate 204, a housing 206, a locking plate 208, and an oil control conduit 210. The locking plate 208 is coupled (e.g., fixedly coupled) to the housing 206 such that their relative positions are substantially fixed. Additionally, the outer cover plate 204 circumferentially encloses the inner cover plate 202, in the depicted example. However, other cover plate positions have been contemplated. The inner cover plate 202 includes openings 212 that facilitate plate attachment to a vane rotor 300, shown in FIG. 3. The outer cover plate 204 also includes openings 214 the enable plate attachment to the housing 206.

Additionally, the housing 206 is positioned axially between the outer and inner cover plates (202 and 204) and the locking plate 208. A central axis 216 and a radial axis 218 are provided in FIG. 2, for reference.

The locking plate 208 include teeth 220. The teeth 220 enable rotational input to be imparted to the phase control apparatus 200. Specifically, in one example, the teeth 220 may be attached to a chain that receives rotational input from a crankshaft, such as the crankshaft 38 shown in FIG. 1. However, other mechanism that enable rotational attachment between the phase control apparatus 200 and the crankshaft 38, have been contemplated, such as a belt and pulley. Therefore, it will be appreciated that the phase control apparatus 200 may rotate in either a clockwise direction 222, in the illustrated example, during engine operation, or a counterclockwise direction 224 about the central axis 216, in other examples.

Continuing with FIG. 2, the oil control conduit 210 is designed to adjust the amount and pressure of oil provided to the vane rotor 300, shown in FIG. 3. Varying the pressure of oil provided to the vane rotor 300 adjusts the phase of the rotor and therefore cam timing in the VCT system 12, shown in FIG. 1. The oil control conduit 210 may be specifically designed with a spool valve to direct oil to the hydraulic chambers 302 inside the housing 206, in one example. Thus, the oil control conduit 210 may act as a spool valve housing with a valve spool enclosed therein.

FIG. 3 shows an exploded view of the phase control apparatus 200, depicted in FIG. 2. Specifically, FIG. 3 shows the inner and outer cover plates, 202 and 204, respectively, the housing 206, the locking plate 208, and the oil control conduit 210. The vane rotor 300 is also illustrated in FIG. 3.

The housing 206 includes hydraulic chambers 302 that accommodate movement of vanes 304 in the vane rotor 300 into advanced and retarded positions. Thus, the relative position of the vanes 304 with regard to the hydraulic chambers 302 may be adjusted to place the phase control apparatus in different advanced or retarded positions. A valve spool of the oil control conduit 210 may be configured to direct oil to certain portions of the hydraulic chambers 302 for phase adjustment. Specifically, in one example, a valve spool enclosed in the oil control conduit may include lands and grooves on a central shaft and axial movement of the shaft may direct oil to different locations in the phase control apparatus to initiate movement of the vane rotor 300 with regard to the housing 206.

The vane rotor 300, and more specifically one of the vanes 304, also includes a bore 306 that houses a locking pin 308. The locking pin 308 is designed to engage with and disengage from a pin recess 310 in the locking plate 208. When engaged the locking pin 308 is mated with the pin recess 310 and when disengaged the locking pin is retracted from the pin recess 310 and spaced away therefrom.

The locking pin 308 includes an outer section 312, a spring 314, and a cap 316 that retains the spring within a central opening 318 of the outer section in the locking pin 308. The spring 314 exerts a force (e.g., axial force) on the outer section 312 of the locking pin when the pin is in a retracted position in the bore 306. Thus, the spring 314 may be configured to preload the locking pin 308. It will be appreciated that in the retracted position the locking pin 308 is not mated with the pin recess 310, as discussed above. The pressure of the oil delivered to the locking pin 308 may urge the locking pin into an engaged or disengaged state. The locking pin may be spring loaded with its default position being the locked position, in one example. However, in other examples, the locking pin's default position may be the unlocked position. In one example, oil pressure within the apparatus may move the locking pin against the spring load and unlocks the vane rotor. The oil pressure in the phase control apparatus 200 that control locking and unlocking of the locking pin 300 may be controlled via the oil control valves, 42 and/or 44, shown in FIG. 1. However, in other examples, the locking pin may be controlled by an electronic actuator.

The locking pin 308 and the pin recess 310 are sized to mate with one another. For instance, a diameter 330 of the locking pin 308 may be slightly less than a diameter 332 of the pin recess 310 to enable the locking pin to be inserted into the pin recess 310.

FIG. 3 also shows a ramped channel 320 included in the locking plate 208. The ramped channel 320 opens into the pin recess 310. Thus, the ramped channel 320 is designed to guide the locking pin 308 into the pin recess 310 when the pin is moved from an unlocked state to a locked state.

FIG. 4 shows a detailed view of the ramped portion of the phase control apparatus 200 shown in FIG. 3. Specifically, the locking pin 308, pin recess 310, and ramped channel 320 in the locking plate 208, are depicted in an engaged state where the locking pin is mated with the pin recess. As illustrated, a thickness 400 (e.g., axial thickness) of the ramped channel 320 increases in a direction toward the pin recess 310. In other words, the depth of the ramped channel 320 grows larger in a direction extending toward the pin recess 310. More specifically, the thickness of the ramped channel 320 may linearly increase in a direction toward the pin recess. However, in other examples, the thickness of the ramped channel 320 may increase such that the bottom of the channel is curved.

Additionally in the example illustrated in FIG. 4, the ramped channel 320 extends through the locking plate 208 in an arc about the central axis 216 of the phase control apparatus 200, shown in FIG. 2. In this way, the ramped channel 320 guides the locking pin 308 during rotation of the vane rotor about the central axis 216, shown in FIGS. 2 and 3.

Continuing with FIG. 4, the locking pin 308 includes a reduced diameter section 402 at one end 404. In the illustrated example, a width 406 of the ramped channel 320 is slightly larger than a diameter 407 of the reduced diameter section 402 to enable the reduced diameter section 402 of the locking pin 308 to be guided by the ramped channel 320. Additionally, in the illustrated example, the width 406 of the ramped channel 320 is less than the diameter 332 of the pin recess 310. However, in other examples, the width 406 of the ramped channel may be substantially equal to the diameter 332 of the pin recess 310.

FIG. 5 shows the phase control apparatus 200 in a locked position and with the inner cover plate 202 and the outer cover plate 204, shown in FIG. 3, removed such that the underlying components in the apparatus can be viewed. In particular, the housing 206 including the hydraulic chamber 302 having the vane 304 of the vane rotor 300 disposed therein are depicted. As illustrated in FIG. 5, the relative positions of the vane rotor 300 and the housing 206 are locked via engagement of the locking pin 308 in the pin recess 310, shown in FIG. 4. However, a small gap 500 exists between a radial face 502 of the vane 304 and an interior surface 504 of the housing 206. Specifically, the radial face 502 is spaced away from a section 510 of the interior surface 504 that is radially aligned and designed stop rotation of the vane rotor in a counterclockwise direction. In this way, impact between the housing 206 and the vane rotor 300, can be avoided to reduce NVH caused by such an impact. The interior surface 504 includes another radially aligned section 512 that is designed to stop rotation of the vane rotor in clockwise direction. Moreover, the other radial face 503 of the vane 304 is also spaced away from the interior surface 504 of the housing 206. Additionally, both the radial faces, 502 and 503, extend from a tangential face 514 of the vane 304.

In the locked position the phase control apparatus 200 may be in a retarded valve timing configuration. That is to say that in the locked position the phase control apparatus 200 may initiate retardation of the valve actuation of an associated valve. However, in other examples, in the locked position the phase control apparatus 200 may be in an advanced valve timing configuration or in a neutral configuration that neither advances nor retards valve timing. The oil control conduit 210 and central axis 216 are also indicated in FIG. 5.

FIG. 6 shows a method 600 for operation of VCT system including a phase control apparatus. Method 600 may be implemented by the engine, VCT system, and phase control apparatus described above with regard to FIGS. 1-5 or may be implemented by other suitable engines, VCT systems, and phase control apparatuses, in other examples.

At 602 the method includes determining a valve actuation timing for a valve. The valve may be either an intake or an exhaust valve in an engine. Furthermore, the valve actuation timing may be determined based on operating conditions such as engine temperature, engine speed, engine load, exhaust gas composition, exhaust gas temperature, manifold air pressure, etc. For example, it may be determined that the timing of the intake valve should be advanced during an idle condition or that the timing of the intake valve should be retarded during a high speed condition.

Next at 604 the method includes adjusting an engagement state of a locking pin and a pin recess based on the valve actuation timing, the locking pin positioned within a bore of a vane in a vane rotor and the pin recess positioned in a cover plate including a drive wheel and a ramped channel opening into the pin recess.

Adjusting the engagement state of the locking pin and the pin recess may include step 606 or step 608. At 606 the method includes moving the locking pin from a locked positioned to an unlocked position. In one example, the locking pin and pin recess are moved into the unlocked position from the locked position responsive to entry into a retarded valve timing condition. For instance, the locking pin may be moved from the locked position to an unlocked position when the engine speed increases above a threshold value. In another example, the locking pin may be unlocked when boost surpasses a threshold value or when boost is initiated. At 608 the method includes moving the locking pin from the unlocked to the locked positioned. In one example, the locking pin and pin recess are moved into the locked position from the unlocked position responsive to entry into an advanced valve timing condition. For instance, the locking pin may be set in a locked state when the engine speed decreases below a threshold value. Specifically in one example, the locking pin may be locked when the engine is running within an idle speed range or below an idle speed threshold when there is not sufficient oil pressure available to operate the phase control apparatus.

Further in one example, adjusting the engagement state of the locking pin and the pin recess includes adjusting an oil pressure the phase control apparatus.

FIG. 7 shows a method 700 for operation of a VCT system including a phase control apparatus. Method 700 may be implemented by the engine, VCT system, and phase control apparatus described above with regard to FIGS. 1-5 or may be implemented by other suitable engines, VCT systems, and phase control apparatuses, in other examples.

At 702 the method includes determining valve actuation timing for a valve. The valve may be either an intake or an exhaust valve in an engine. Furthermore, the valve actuation timing may be determined based on operating conditions such as engine temperature, engine speed, engine load, exhaust gas composition, exhaust gas temperature, manifold air pressure, etc., as previously discussed.

At 704 the method includes determining if a locking pin is slated to be in a locked position or an unlocked position. In one example, it may be determined that the locking pin is slated to be in the locked position when the engine speed is below a threshold value. For instance, it may be determined that the locking pin is slated to be in a locked position and engaged within the pin recess, when the engine is within an idle speed range.

If it is determined that the locking pin is slated to be engaged in the pin recess, the method advances to 706. At 706 the method includes extending the locking pin into the ramped channel and guiding the locking pin into the pin recess. In this way, the locking pin can be smoothly engaged and disengaged with pin recess via the ramped channel. As a result, the likelihood of the locking pin not engaging with the pin recess is reduced, thereby reducing the chance of the vane rotor striking the housing due to a failed engagement attempt. Therefore, the noise caused by the impact between the housing and the vane rotor can be avoided, thereby increasing the longevity of the phase control apparatus and avoiding customer dissatisfaction caused by the noise. In one example, the locking pin may be engaged with the pin recess during a retarded valve timing condition where it is desirable to retard valve timing. For instance, it may be desirable to retard valve timing during engine idle (e.g., when the engine speed is below an idle threshold).

On the other hand, if it is determined that the locking pin is slated to be unlocked and disengaged from the pin recess the method proceeds to 708. At 708 the method includes retracting the locking pin from the pin recess. In one example, the locking pin may be disengaged from the pin recess during an advanced valve timing condition where it is desirable to advance valve timing. For instance, it may be desirable to advance valve timing during high engine speeds.

The technical effect of providing a ramped channel in a phase control apparatus that guide a locking pin into a pin recess is a reduction in NVH and an increase in the longevity of the phase control apparatus.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will further be described in the following paragraphs. In one aspect, a phase control apparatus for a camshaft is provided that includes a locking plate including a drive wheel, a pin recess, and a ramped channel opening into the pin recess; a housing coupled to the locking plate; a vane rotor including a vane and positioned in a hydraulic chamber of the housing; and a locking pin positioned within a bore of the vane and movable into a locked position where the locking pin engages with the pin recess.

In another aspect, a phase control apparatus for a camshaft is provided that includes a locking plate including a drive wheel, a pin recess, and a ramped channel opening into the pin recess; a housing coupled to the locking plate; a vane rotor including a vane and positioned in a hydraulic chamber of the housing; and a locking pin preloaded by a spring and positioned within a bore of the vane and movable into a locked position where the locking pin engages with the pin recess and into an unlocked position where the locking pin is disengaged from the pin recess; where during movement of the locking pin into the locked position from the unlocked position the locking pin is guided by the ramped channel into the pin recess.

In yet another aspect, a method for operating a phase control apparatus is provided, the method includes determining valve actuation timing for a valve; and adjusting an engagement state of a locking pin and a pin recess based on the valve actuation timing, the locking pin positioned within a bore of a vane in a vane rotor and the pin recess positioned in a locking plate including a drive wheel and a ramped channel opening into the pin recess.

In any of the aspects herein or combinations of the aspects, during movement of the locking pin into the locked position the locking pin may be guided by the ramped channel into the pin recess.

In any of the aspects herein or combinations of the aspects, the locking pin may be moveable into an unlocked position in which the locking pin is spaced away from the pin recess.

In any of the aspects herein or combinations of the aspects, during movement of the locking pin from the unlocked position to the locked position an end of the locking pin may extend into the ramped channel.

In any of the aspects herein or combinations of the aspects, the locking pin may be moved into the locked and unlocked positions based on an oil pressure in an engine.

In any of the aspects herein or combinations of the aspects, a thickness of the ramped channel may decrease in direction extending away from the pin recess.

In any of the aspects herein or combinations of the aspects, the ramped channel may extend in an arc along the locking plate.

In any of the aspects herein or combinations of the aspects, the phase control apparatus further includes a spring preloading the locking pin.

In any of the aspects herein or combinations of the aspects, in the locked positioned the phase control apparatus may be in an advanced valve timing configuration.

In any of the aspects herein or combinations of the aspects, in the locked position radial faces of the vane may not in face sharing contact with an interior surface of the housing.

In any of the aspects herein or combinations of the aspects, a depth of the ramped channel may increase linearly in an arc extending toward the pin recess.

In any of the aspects herein or combinations of the aspects, adjusting the engagement state of the locking pin and the pin recess may include moving the locking pin from a locked positioned to an unlocked position.

In any of the aspects herein or combinations of the aspects, the locking pin and pin recess may be moved into the unlocked position from the locked position responsive to entry into a retarded valve timing condition.

In any of the aspects herein or combinations of the aspects, adjusting the state of the pin may include moving the locking pin from an unlocked to a locked positioned.

In any of the aspects herein or combinations of the aspects, the locking pin and pin recess may be moved into the locked position from the unlocked position during an advanced valve timing condition.

In any of the aspects herein or combinations of the aspects, adjusting the engagement state of the locking pin and the pin recess may include adjusting an oil pressure the phase control apparatus.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A phase control apparatus for a camshaft, comprising:

a locking plate including a drive wheel, a pin recess, and a ramped channel opening into the pin recess, the ramped channel increasing channel depth in a direction extending toward the pin recess;

a housing coupled to the locking plate;

a vane rotor including a vane and positioned in a hydraulic chamber of the housing; and a locking pin positioned within a bore of the vane and movable into a locked position where the locking pin engages with the pin recess.

2. The phase control apparatus of claim 1, where, during movement of the locking pin into the locked position, the locking pin is guided by the ramped channel into the pin recess.

3. The phase control apparatus of claim 1, where the locking pin is moveable into an unlocked position in which the locking pin is spaced away from the pin recess.

4. The phase control apparatus of claim 3, where, during movement of the locking pin from the unlocked position to the locked position, an end of the locking pin extends into the ramped channel.

5. The phase control apparatus of claim 3, where the locking pin is moved into the locked and unlocked positions based on an oil pressure in an engine.

6. The phase control apparatus of claim 1, where a thickness of the ramped channel decreases in a direction extending away from the pin recess.

7. The phase control apparatus of claim 1, where the ramped channel extends in an arc along the locking plate.

8. The phase control apparatus of claim 1, further comprising a spring preloading the locking pin.

9. The phase control apparatus of claim 1, where, in the locked position, the phase control apparatus is in a retarded valve timing configuration.

10. The phase control apparatus of claim 1, where, in the locked position, radial faces of the vane are not in face sharing contact with an interior surface of the housing.

11. A phase control apparatus for a camshaft, comprising:

a locking plate including a drive wheel, a pin recess, and a ramped channel opening into the pin recess, the ramped channel increasing channel depth in a direction extending toward the pin recess;

a housing coupled to the locking plate;

a vane rotor including a vane and positioned in a hydraulic chamber of the housing; and a locking pin preloaded by a spring and positioned within a bore of the vane and movable into a locked position where the locking pin engages with the pin recess and into an unlocked position where the locking pin is disengaged from the pin recess;

where, during movement of the locking pin into the locked position from the unlocked position, the locking pin is guided by the ramped channel into the pin recess.

12. The phase control apparatus of claim 11, where a depth of the ramped channel increases linearly in an arc extending toward the pin recess.

13. The phase control apparatus of claim 11, where, in the locked position, radial faces of the vane are not in face sharing contact with an interior surface of the housing.

14. The phase control apparatus of claim 11, where, in the locked position, the phase control apparatus is in a retarded valve timing configuration.

15. The phase control apparatus of claim 11, wherein an axial thickness of the ramped channel increases linearly in the direction toward the pin recess.

* * * * *